US007249634B2

(12) United States Patent
de Albuquerque Lima Goncalves et al.

(10) Patent No.: US 7,249,634 B2
(45) Date of Patent: Jul. 31, 2007

(54) APPARATUS FOR PRODUCTION IN OIL WELLS

(75) Inventors: Marcelo de Albuquerque Lima Goncalves, Rio de Janeiro (BR); Odair Geraldo dos Santos, Salvador (BR); Alcino Resende De Almeida, Rio de Janeiro (BR)

(73) Assignee: Petroleo Brasileiro S.A. - Petrobras, Rio de Janeiro (BR)

( * ) Notice: Subject to any disclaimer, the term of this patent is extended or adjusted under 35 U.S.C. 154(b) by 0 days.

(21) Appl. No.: 10/918,311

(22) Filed: Aug. 14, 2004

(65) Prior Publication Data

US 2005/0167116 A1 Aug. 4, 2005

(51) Int. Cl.
*E21B 29/12* (2006.01)

(52) U.S. Cl. ..... 166/335; 166/372; 166/54.1; 166/268

(58) Field of Classification Search ..... 166/335, 166/52, 54.1, 268, 368, 372
See application file for complete search history.

(56) References Cited

U.S. PATENT DOCUMENTS

| | | | | |
|---|---|---|---|---|
| 3,750,753 | A * | 8/1973 | Bernard | 166/309 |
| 3,987,852 | A * | 10/1976 | Terry | 166/261 |
| 4,848,471 | A * | 7/1989 | Bencze | 166/335 |
| 6,688,392 | B2 * | 2/2004 | Shaw | 166/366 |
| 2001/0007283 | A1 * | 7/2001 | Johal et al. | 166/265 |
| 2003/0217848 | A1 * | 11/2003 | Shaw | 166/366 |
| 2005/0028984 | A1 * | 2/2005 | Donald et al. | 166/368 |

* cited by examiner

*Primary Examiner*—Thomas A. Beach
(74) *Attorney, Agent, or Firm*—TraskBritt, P.C.

(57) ABSTRACT

An apparatus uses at least one injection pump (9) positioned in proximity to an undersea petroleum well (10) to provide hydraulic fluid for hydraulic pumping equipment positioned in the bottom of the well, in order to cause a flow of produced oil. The injection pump (9) is able to suction hydraulic fluid from a tank of hydraulic fluid (8) positioned on the deck of a service unit (40). Alternatively, injection pump (9) is able to utilize water from the sea as a hydraulic fluid. Alternatively, the injection pump (9) may be integral with a Christmas tree manifold (6) or may be installed in an auxiliary well (90) in order that it's external portion does not enter into contact with seawater.

6 Claims, 4 Drawing Sheets

APPARATUS FOR PRODUCTION IN OIL WELLS

BACKGROUND OF THE INVENTION

1. Field of the Invention

The instant invention relates to an apparatus for production from oil wells. More particularly, the present invention relates to an apparatus that utilizes at least one injection pump, positioned in proximity to a subsea petroleum well, to provide hydraulic fluid for hydraulic pumping equipment positioned in the bottom of the well, in order to cause a flow of production oil.

2. State of the Art

The process of petroleum production includes the flow from a geological formation or reservoir, positioned at some hundreds or perhaps some thousands of meters below the surface, to installations positioned on the surface.

In the beginning of production from a reservoir the natural pressure normally is sufficient to establish the drainage of oil towards the surface. Thereafter, owing to the degree that the oil reserves of the reservoir are being exploited with the consequent diminution of pressure from the reservoir, it becomes necessary to employ a method for pumping the fluid from the well towards the surface, this operation is known as "an artificial lifting of petroleum."

Some methods for lifting the petroleum from the well are known, for example, a pneumatic pump (also known in English as a "gas lift"), the use of bottom pumps, that maybe either of a centrifugal or reciprocating type.

The selection of the type of artificial petroleum lifting that will be utilized is done as a function of the characteristics of the well, its fluid and the available resources at the production site.

One of the available methods of lifting is the hydraulic jet pump (HJP) also known in English as "jet pumping". In the present description, for the sake of simplification, this method will hereinafter be referred to simply as HJP.

The operational principle of the HJP is similar to that of ejectors, of the type usually found in processing plants. Basically, this system of production includes a tank for storage of hydraulic fluid, a hydraulic fluid injection pump, an ejector or injection pump and a separating vessel. Among these elements, only the ejector is located in the interior of the well.

The hydraulic fluid may be different from the produced oil and is pumped at high pressure toward the interior of the well by an injection pump. In the location in which the ejector is installed, in the bottom of the well, the hydraulic fluid is forced to flow through a restriction which includes an injection nozzle.

With this occurs a transformation of pressure energy to kinetic energy, in conformance to the first law of Thermodynamics. In the suction of the ejector, which is a point of low pressure, an entry of fluid, provided by the reservoir, occurs, owing [due] to the suction effects caused by the low pressure in the nozzle.

Soon thereafter, downstream of this point, there is a narrowing of the flow path, e.g. a throat, where an effective mixing of the hydraulic fluid and the fluid, provided from the reservoir, occurs. This results in the formation of a single fluid flow.

Thereafter, this fluid flow passes through a diffuser, where the area of flow increases gradually, which causes a transformation of the kinetic energy into energy of pressure, and with this the mixture of oil, provided from the formation, and the hydraulic fluid flow toward the surface.

The HJP has the following application advantages:

a) There are no moving parts in the interior of the well, which results in a device having great durability;

b) In certain configurations the bottom pump may be recovered by a reverse flow, thereby avoiding any necessity of an intervening operation in the well to substitute the pump;

c) An easy injection of chemical products, such as corrosion inhibitors is made possible;

d) In the case of a reservoir which produces heavy oil, one may utilize the hydraulic fluid to reduce the viscosity of the fluid produced by the reservoir either by diluting it, if a lighter oil is used as a hydraulic fluid, or by forming an inverse emulsion, if water is used as a hydraulic fluid;

e) It exhibits a good tolerance to sand and gas.

On the other hand, HJP presents some disadvantages which may be distinguished as follows:

A) Low energy efficiency which requires, a larger consumption of energy for its operation in comparison with other methods of artificial petroleum lifting. On the other hand, for petroleum wells, especially subsea wells, this factor is not relevant because in these situations the cost of energy is very low when compared with the other operational costs of the other methods of artificial petroleum lifting, such as the cost of intervention to repair or replace pumps positioned in the bottom of the well;

B) If the hydraulic fluid is water, it is necessary to undergo a separation process in the installations on the surface which may significantly overload the processing system;

C) Since an addition of liquid occurs in the region where the ejector is located, there is a diminution in the fraction of gas and consequently an increase in the apparent average specific mass inside the column of production. As a consequence of this the required discharge pressure of the pump also increases, making the whole system, i.e. the well, the injection pump, the Christmas tree and flowlines, operating at high pressure. This particular aspect represents a great limitation in the use of the HJP, in that high operational pressures require equipment that is much more robust, more expensive, and subject to major risks of accidents and leakage.

In review, an analysis of this method indicates that the major benefit of the HJP relates to its durability, the fact that there are no moving parts in the interior of the well. On the other hand, its limitation for application is, in many cases, the high pressure required for the injection of the hydraulic fluid.

In the case of the petroleum well being a subsea well, the situation is more serious in that usually the distance between the location of the platform, on which the injection pump is installed, and the subsea wellhead is much larger, generally more than a kilometer. In this case there would be the inconvenience of having to provide a hydraulic conduit, of a considerable length which would be able to support elevated pressures. This would increase the costs and the operational risks.

A method of hydraulic pumping by way of a piston (HPP) is also known in the art In this method an reciprocating double action piston pump is connected through an actuated piston axle to an reciprocating double action piston hydraulic motor. The motor and the pump are similar in their constructive aspects.

Hydraulic fluid is fed to this system to actuate an reciprocating ascending/descending of the piston of the motor. This motor piston is connected to the piston of the pump and as a consequence the latter also effects reciprocating movements that are ascending and descending.

When the piston pump affects a descending movement, at that same time there will occur a suction of the fluid to be pumped, into the superior chamber of the pump. There will be a discharge of fluid through the lower chamber.

When the pump piston effects an ascending movement, the situation will be inverted and the suctioned fluid will then to be discharged, initiating in this moment a new entry of fluid into the lower chamber.

As may be observed the instant process is a cyclical process.

The use of hydraulic turbines in petroleum wells for actuating a rotative hydraulic pump is also known. Examples of such a use include methods of using submerse centrifugal pumps (SCP) and progressive cavity pumps (PCP).

In a SCP a hydraulic turbine actuates an axial centrifugal pump; alternatively an assembly of these pumps may be connected in series. In a PCP a turbine actuates a screw pump. These two methods are well known in the art and will not be described herein in view of their being well known by those skilled in the art.

In conclusion, every pumping system that utilizes reciprocating pumps or rotative pumps to drain a petroleum reservoir from a production well either by means of the use of a hydraulic motor or by means of the use of a hydraulic turbine will always suffer limitations in its operation due to the elevated pressures of the hydraulic fluid injection system.

The present invention provides an apparatus that solves the problems mentioned above related to the high pressure injection of hydraulic fluid required by the bottomhole hydraulic pumping equipment, as will be seen in the following.

BRIEF DESCRIPTION OF THE DRAWINGS

The invention will be described hereinafter with reference to the figures annexed hereto. The drawings form an integral part of the present description and, merely for purposes of illustration, depict the preferred embodiments of the invention.

DETAILED DESCRIPTION OF THE INVENTION

Figure 1:
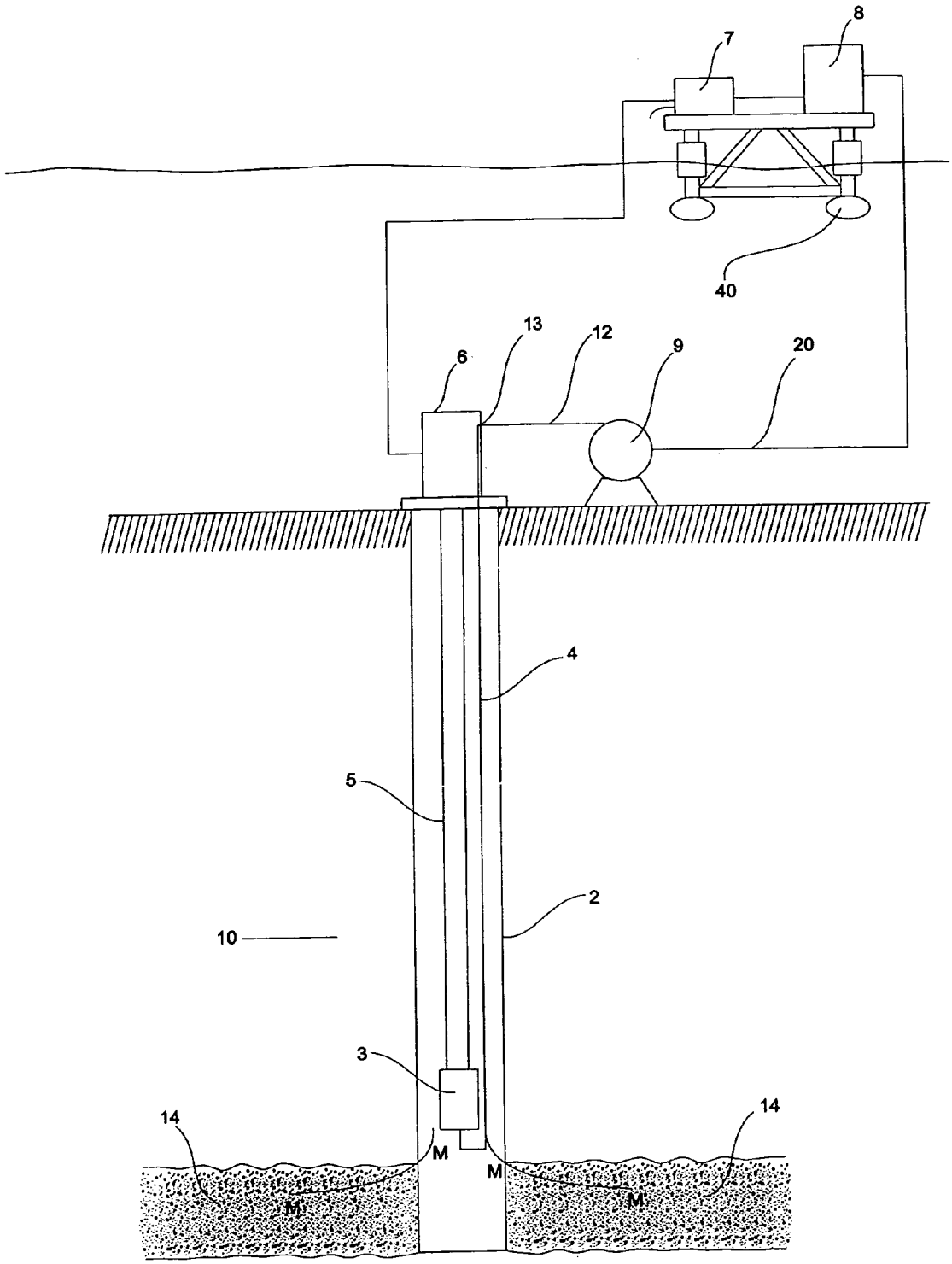
FIG. 1 illustrates a first embodiment of the apparatus of the present invention.

In FIG. 1 is shown a first embodiment of the invention. As shown a subsea petroleum well 10 is provided on its upper part with a Christmas tree 6. The petroleum well 10 is provided in its interior with a casing 2, in the interior of which is installed a production tubing 5. The casing 2 and the production tubing 5 are connected at their respective upper ends to the Christmas tree 6.

At some point in the production tubing 5, preferentially in its lower extremity, hydraulic pumping equipment 3 is provided. A Christmas tree 6 is positioned on the surface to which the production tubing 5 is connected.

The hydraulic pump equipment 3 may be an ejector, for use with a HJP; alternatively, the equipment may be an assembly of a hydraulic motor or hydraulic turbine/rotative pump, for use with a SCP or with a PCP, or alternatively a hydraulic motor/alternative pump for use with a HPP.

An injection pump 9 is installed in proximity to the petroleum well 10, and the discharge of this pump is connected by way of hydraulic fluid connection tubing 12 to an injection tubing connection point 13 in the Christmas tree 6. The suction tubing of the hydraulic fluid 4 connects this injection tubing connection point 13 to the hydraulic pumping equipment 3.

A hydraulic fluid tank 8 is provided, positioned on the surface in a service unit 40, which may be a fixed or floating platform, a ship, or any other unit for collecting produced fluids, that may be positioned on land. The injection pump 9 sucks hydraulic fluid from the tank of hydraulic fluid 8 through a suction tubing 20 and pumps hydraulic fluid pump to the hydraulic pumping equipment 3 through the hydraulic fluid conduction tubing 12, to the injection tubing connection point 13 and to the hydraulic fluid injection tubing 4.

By this approach one avoids the necessity of providing hydraulic tubing of great length having the capacity of supporting highly elevated pressures, which diminishes costs and operation risks.

Figure 2:
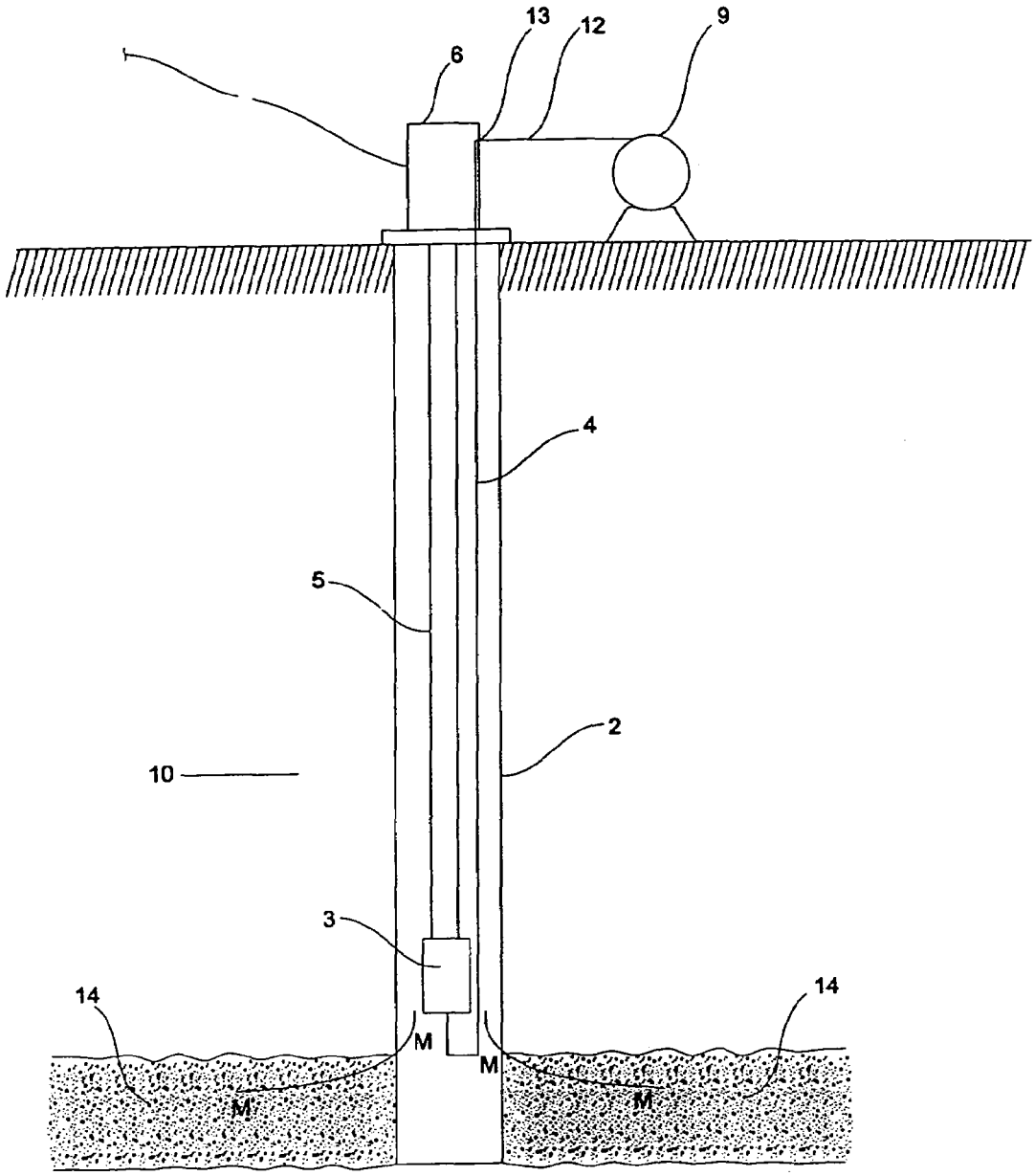
FIG. 2 illustrates a second embodiment of the apparatus of the present invention.

FIG. 2 illustrates a second embodiment of the apparatus which is the subject of the instant invention. The principal difference between the embodiment of FIG. 1 and the embodiment of FIG. 2 is that in the embodiment of FIG. 2 the injection pump 9 sucks water from the sea and that sea water is then utilized as hydraulic fluid. In this embodiment the injection pump is a pump whose external portion operates in direct contact with the water from the sea.

Although in FIGS. 1 and 2 the injection pump 9 has been illustrated in a configuration wherein it is detached or separated from the Christmas tree 6, nothing impedes the injection pump from being mounted in conjunction with the Christmas tree in such a way that these two devices form an integral structure.

A disadvantage that the embodiments of FIGS. 1 and 2 have is the fact that the injection pump 9 operates in the severe conditions found on the seabed. Although such equipment is known in the art, this solution, besides being expensive, would require new developments for its implementation in order to increase the level of confidence in this equipment.

Figure 3:
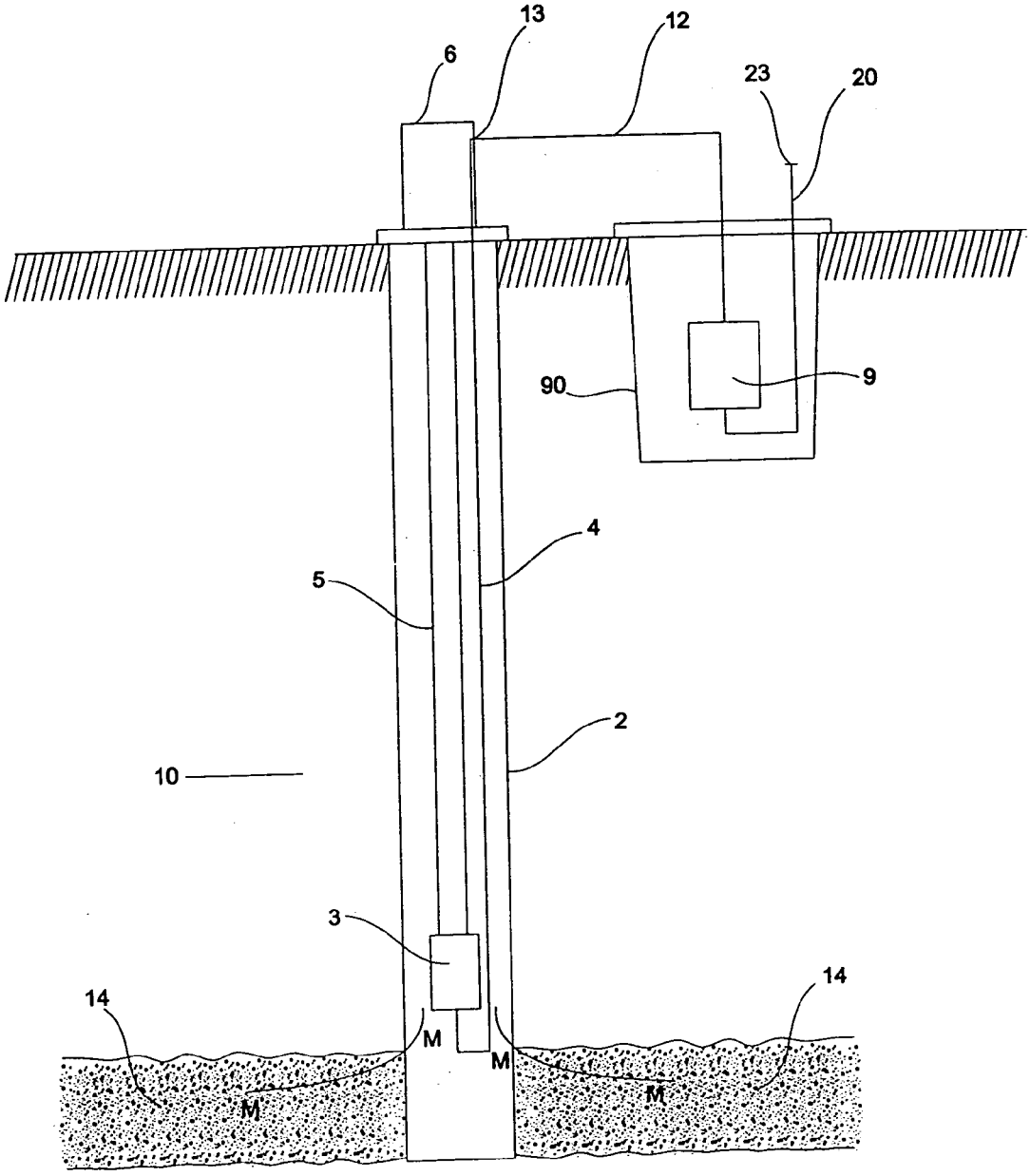
FIG. 3 illustrates a third embodiment of the apparatus of the instant invention.

In FIG. 3 a third embodiment of the apparatus of the instant invention is disclosed. In this embodiment the injection pump 9 is mounted in the interior of an auxiliary well 90. In this embodiment it is not necessary that the injection pump be a pump whose external portion operates in direct contact with seawater. The injection pump 9 sucks water from the sea through a suction point 23 and a suction tubing 20.

This substantially reduces the installation costs, in that a pump whose external portion operates in direct contact with the seawater is a type of equipment having substantially elevated costs associated therewith. In this case one may use, for example, an axial centrifugal pump similar to that which is employed in a submersed centrifugal pump (SCP), which has a substantially lower cost associated therewith.

Figure 4:
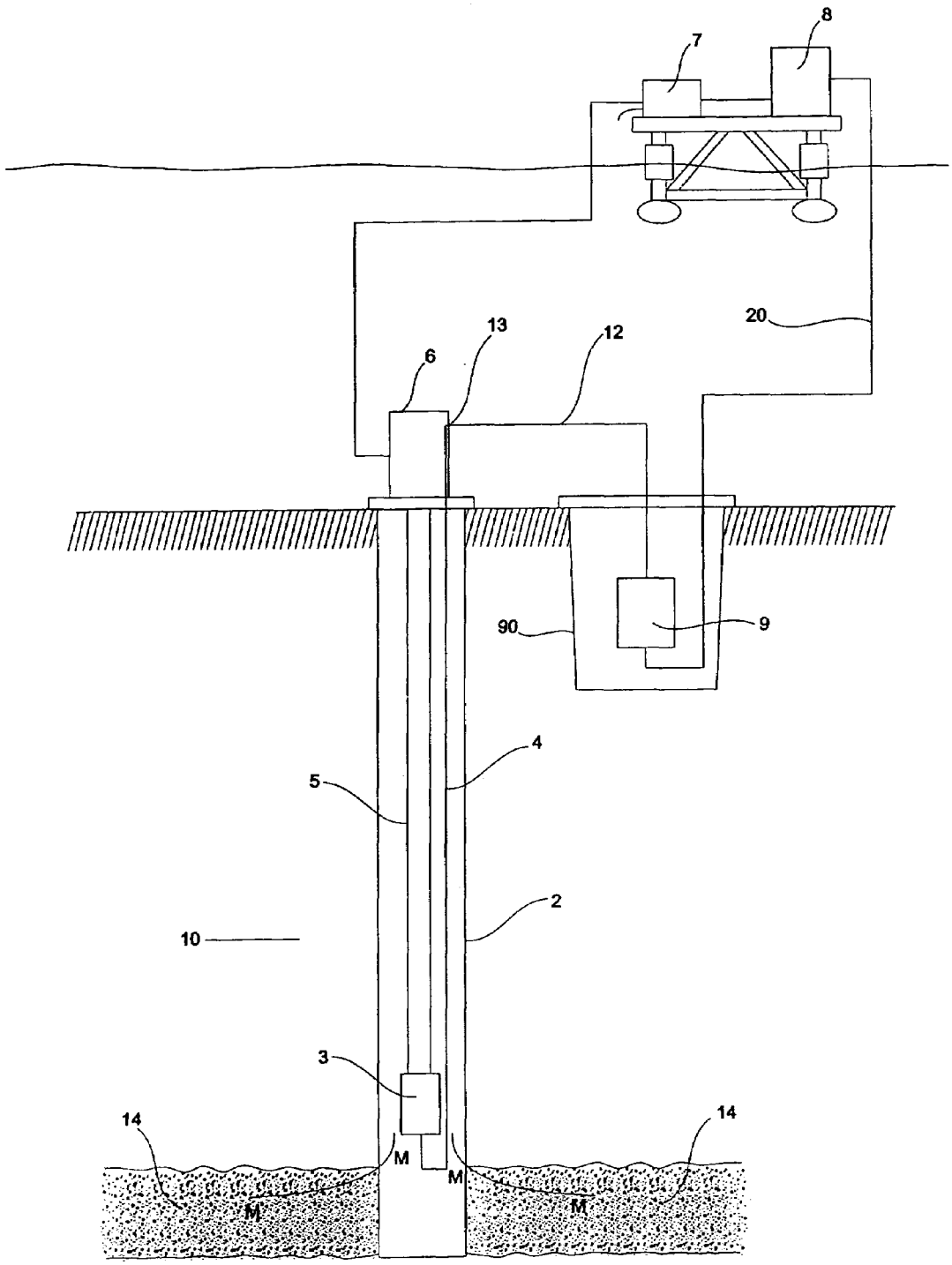
FIG. 4 illustrates a fourth embodiment of the apparatus of the instant invention.

A fourth embodiment of the present invention is disclosed in FIG. 4. In this embodiment the injection pump 9, positioned in the interior of an auxiliary well 90, operates to suck hydraulic fluid from a tank of hydraulic fluid 8, positioned in a service unit 40 on the surface, as illustrated in FIG. 4.

One should recognize that although the present description has consistently indicated the use of only one injection pump, nothing precludes the use of more than one pump, installed in series.

There may exist situations wherein it became necessary to install a second injection pump in the service unit 40, for example, to provide hydraulic fluid, at high pressure to the injection pump 9. In this case the component would be better designated as injection equipment which includes at least one injection pump.

The number of pumps to be employed will depend on factors such as the characteristics of the hydraulic fluid, the fluid to be pumped, and the depth at which the pumps are to be installed in the underwater well, etc. and the project manager of the system will make the choice that best attends to the necessities.

The invention was herein described in relation to its preferred embodiments. It should therefore be mentioned that the invention is not limited to these embodiments, in that those with ordinary skill in the art will perceive that the basic principles of the invention may be applied in diverse manners to those described herein without departing from the inventive concept of the invention. Therefore the invention is only limited to the scope of the claims annexed to the present specification.

What is claimed is:

1. An apparatus for the production of a subsea petroleum well (10) wherein fluids originating from a reservoir (14) flow toward the interior of said subsea petroleum well (10), said apparatus comprising:

a Christmas tree manifold (6);

a casing (2) whose upper end is connected to the Christmas tree manifold (6);

a production tubing (5), installed in the interior of the casing (2), whose upper end is connected to the Christmas tree manifold (6);

hydraulic pump equipment (3) connected to the lower end of the production tubing (5);

an injection pump (9) which provides hydraulic fluid to the hydraulic pump equipment;

said apparatus being characterized by being additionally provided with:

a suction tubing (20) which connects the suction inlet of said injection pump (9) to a tank of hydraulic fluid (8) positioned on the surface in a service unit (40);

a hydraulic fluid conduction tubing (12) which connects the discharge outlet of said injection pump (13) to an injection tubing connection point (13), located on the Christmas tree manifold (6);

an injection tubing for hydraulic fluid (4) which connects the injection tubing connection point (13) to the hydraulic pump equipment (3):

wherein the injection pump (9) is installed in proximity to the underwater petroleum well (10) and an external portion of the injection pump (9) operates in contact with seawater.

2. An apparatus for the production of a subsea petroleum well (10) wherein the fluids originating from a reservoir (14) flow to the interior of said petroleum well (10), said apparatus comprising:

a Christmas tree manifold (6);

a casing (2) whose upper end is connected to the Christmas tree manifold (6);

a production tubing (5), installed in the interior of said casing (2) having am upper end connected to the Christmas tree manifold (6);

hydraulic pumping equipment (3), connected to the lower end of the production tubing (5);

an injection pump (9) for providing hydraulic fluid to said hydraulic pumping equipment (3);

said apparatus being characterized by being additionally provided with:

a conduction tubing for hydraulic fluid (12) which connects the discharge outlet of the injection pump (9) to an injection tubing connection point (13) positioned in the Christmas tree manifold (6);

an injection tubing for hydraulic fluid (4) which connects the injection tubing connection point (13) to the hydraulic pumping equipment (3);

wherein the injection pump (9) is installed in proximity to the underwater petroleum well (10) and an external portion of the injection pump (9) operates in contact with seawater and the fluid pumped by the injection pump (9) is seawater.

3. Apparatus for the production of a subsea petroleum well (10) wherein the fluids originating from a reservoir (14) flow towards the interior of said subsea petroleum well (10), said apparatus comprising:

a Christmas tree manifold (6);

a casing (2) whose upper end is connected to the Christmas tree manifold (6);

a production tubing (5) installed in the interior of the casing (2) whose upper end is connected to the Christmas tree manifold (6);

hydraulic pumping equipment (3) connected to the lower end of the production tubing (5);

an injection pump (9) for providing hydraulic fluid to the hydraulic pumping equipment (3);

a discharge outlet of the injection pump (9) being connected by way of injection tubing for hydraulic fluid (4) to the hydraulic pumping equipment (3);

said apparatus being characterized by:

an injection pump (9) mounted in conjunction with the Christmas tree manifold (6) in a way such that the injection pump (9) and the Christmas tree manifold form an integral assembly.

4. The apparatus according to claim 3 characterized by a hydraulic fluid, pumped by the injection pump (9), being seawater.

5. An apparatus for production from undersea petroleum well (10) wherein fluids originating from a reservoir (14) flow toward the interior of said underwater petroleum well (10), said apparatus comprising:

a Christmas tree manifold (6);

a casing (2) whose upper end is connected to the Christmas tree (6);

a production tubing (5) installed in the interior of the casing (2) whose upper end is connected to the Christmas tree manifold (6);

hydraulic pumping equipment (3) connected to a lower end of the production tubing (5);

an injection pump (5) for providing hydraulic fluid for the hydraulic pumping equipment (3);

said apparatus being characterized by being additionally provided with:

a suction tubing (20) which connects a suction inlet of the injection pump (9) to a tank of hydraulic fluid (8), positioned on the surface in a service unit (40);

a hydraulic fluid conduction tubing (12) which connects the injection tubing connection point (13) to the hydraulic pumping equipment;

wherein the injection pump (9) is installed in the interior of an auxiliary well (90) and an external portion of the injection pump (9) operates in the interior of the auxiliary well (90) without maintaining contact with seawater.

6. An apparatus for production from an undersea petroleum well (10) wherein fluids originating from a reservoir (14) flow toward the interior of said undersea petroleum well (10), said apparatus comprising:

a Christmas tree manifold (6);

a casing (2) whose upper end is connected to the Christmas tree manifold (6);

a production tubing (5) installed in the interior of the casing (2) having an upper end connected to the Christmas tree manifold (6);

hydraulic pumping equipment (3) connected to the lower end of the production piping (5);

an injection pump (9) for providing hydraulic fluid to the hydraulic pumping equipment (3);

wherein said apparatus is characterized by additionally being provided with:

a hydraulic fluid conduction tubing (12) which connects the discharge outlet of the injection pump (9) to a point of connection of the injection tubing (3), positioned in a Christmas tree (6); and a hydraulic fluid injection tubing (4) which connects the injection tubing connection point (13) to the hydraulic pumping equipment (3);

wherein the injection pump (9) is installed in the interior of an auxiliary well (90) and an external portion of the injection pump (9) operates in the interior of the auxiliary well (90) without maintaining contact with seawater and a hydraulic fluid, pumped by the injection pump (9) is seawater.

* * * * *